US007874555B2

(12) United States Patent
Nakashima

(10) Patent No.: US 7,874,555 B2
(45) Date of Patent: Jan. 25, 2011

(54) FEEDING APPARATUS, RECORDING APPARATUS AND LIQUID EJECTING APPARATUS

(75) Inventor: Hiroki Nakashima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 92 days.

(21) Appl. No.: 11/763,478

(22) Filed: Jun. 15, 2007

(65) Prior Publication Data

US 2008/0061491 A1 Mar. 13, 2008

(30) Foreign Application Priority Data

Jun. 15, 2006 (JP) ..... 2006-166534

(51) Int. Cl.
*B65H 5/26* (2006.01)

(52) U.S. Cl. ..... 271/9.12; 271/264; 271/9.01; 347/104

(58) Field of Classification Search ..... 271/4.08, 271/10.09, 121, 264, 109, 9.12, 9.01; 347/104
See application file for complete search history.

(56) References Cited

U.S. PATENT DOCUMENTS 5,648,808 A * 7/1997 Yanagi et al. ..... 347/104
6,612,762 B1 * 9/2003 Sakurai et al. ..... 400/542
6,793,425 B2 * 9/2004 Yoshikawa et al. ..... 400/624
2004/0036756 A1 * 2/2004 Nakano et al. ..... 347/104

FOREIGN PATENT DOCUMENTS

JP 11-139587 A 5/1999
JP 2004-175531 A 6/2004

* cited by examiner

*Primary Examiner*—Stefanos Karmis
*Assistant Examiner*—Ernesto Suarez
(74) *Attorney, Agent, or Firm*—Sughrue Mion, PLLC

(57) ABSTRACT

A feeding roller is operable to pick up a stacked first medium and to feed the picked up first medium. A medium guide is adapted to guide the fed first medium. A pair of transporting rollers is operable to transport the glided first medium. The feeding roller is disposed at one side deviated from the center of the medium guiding section in a main scanning direction which is a widthwise direction of the fed first medium. The medium guiding section has a first guide section and a second guide section having path for guiding the fed first medium different from that of the first guide section, the first guide section and the second guide section arranged in the main scanning direction. The first guide section is disposed at the one side where the feeding roller is deviated in the main scanning direction. The second guide section is disposed at the other side in the main scanning direction.

6 Claims, 8 Drawing Sheets

FEEDING APPARATUS, RECORDING APPARATUS AND LIQUID EJECTING APPARATUS

The disclosure of Japanese Patent Application No. 2006-166534 filed Jun. 15, 2006 including specification, drawings and claims is incorporated herein by reference in its entirety.

BACKGROUND

The present invention, relates to a feeding apparatus including a feeding roller picking up a stacked first medium and feeding the picked-up first medium downstream, a medium guiding section guiding the fed first medium to a pair of rollers, and the pair of rollers transporting the guided first medium to a recording section, a recording apparatus and a liquid ejecting apparatus which have the feeding apparatus.

Here, the liquid ejecting apparatus is not limited to recording apparatuses such as an ink jet recording apparatus, a copy machine, and a facsimile which perform recording on a recording material by ejecting ink to the recording material such as a recording paper from a recording head as a liquid ejecting head. The liquid ejecting apparatus includes a kind of apparatus for attaching the liquid to an ejection material corresponding to the recording material by ejecting the liquid utilised in place of ink for its equivalent usage to the ejection material from the liquid ejecting head corresponding to the recording head. As the liquid ejecting head, besides the above-mentioned recording head, there are a color material ejecting head used for manufacturing a color filter such as a liquid crystal display, an electrode material (conductive paste) ejecting head used for manufacturing an electrode such as an organic EL display or a field emission display (FED), a bioorganic material ejecting head used for manufacturing a biochip, a sample ejecting head as a minute pipette, etc.

As described in Japanese Patent Publication No. 11-139587A, a known feeding apparatus includes a hopper in which sheets are stacked and a feeding roller which picks up a top-most sheet from the stacked sheets and feeds the picked-up sheet downstream. The feeding roller is disposed at a position deviated from the center in a main scanning direction which is a widthwise direction of the sheet. Accordingly, even when sheets of different sizes are fed, sheets of all sides are configured to be fed by using a side edge restricting section disposed close to a position where the feeding roller is deviated as a reference (that is, by using a 1-column side as a reference), whereby it is possible to cope with the sheets of all sizes with one feeding roller.

However, when a sheet having a comparatively large width is fed, a force of the feeding roller pressing the sheet is not imposed to a side opposed to the side where the feeding roller is deviated from the center in the main scanning direction. For this reason, on the opposed side, the sheet is lifted in feeding, whereby there is a possibility that a skew will occur. Hereinafter, a cause of occurrence of the skew by the lifting will be described with reference to FIGS. 8(A) and 8(B).

FIGS. 8(A) and 8(B) are side sectional views frustrating a transport path of the known feeding apparatus. Of them, FIG. 8(A) illustrates a configuration in which an auxiliary feeding roller is not disposed. Meanwhile, FIG. 8(B) illustrates a configuration in which the auxiliary feeding roller is disposed.

As shown in FIG. 8(A), a known feeding apparatus 500 includes a feeding roller 501 having a D shape as viewed from a side surface deviated to the 1-column side in the main scanning direction, a retard roller 506 serving as separation means disposed to be in outer contact with the feeding roller 501, a pair of transporting rollers 503 transporting the sheet to a recording section (not shown) disposed downstream, and a guide section 505 which is disposed in a base section 504 and which guides the sheet fed between the feeding roller 501 and the pair of transporting rollers 503. When the sheet is fed to the pair of rollers 503, a 1-column side 508 of the sheet adjacent to the feeding roller 501 in the main scanning direction is pinched between the feeding roller 501 and the retard roller 506 in a frontage opening section 507 constituted by a holder section 502 and the base section 504, whereby the position thereof is restricted.

Meanwhile, an 80-column side 509 of the sheet opposed to the 1-column side is far from the feeding roller 501 and a positional restriction performed by the pinching is not imposed to the 80-column side 509 of the sheet, whereby there is a possibility that lifting will occur. When the lifting occurs as described above, there is a difference between the 1-column side 508 of the sheet and the 80-column side 509 of the sheet on a sheet path (track) ranging from the frontage opening section 507 to the pair of transporting rollers 503. Specifically, since the sheet path (track) on the 80-column side 508 of the sheet takes a short cut by a lifting distance, the sheet path (track) on the 80-column side 509 of the sheet where the lifting occurs is shorter than the sheet path (track) on the 1-column side 508. Here, reference numeral 511 represents is an origin upstream of the sheet path (track) of the 1-column side of the sheet and the sheet path (track) of the 80-column side of the sheet.

Accordingly, the sheet path on the 80-column side of the sheet is shortened by taking the shortcut and thus, the 80-column side of the sheet is precedently fed to the pair of rollers 503, whereby the skew occurs.

As shown in FIG. 8(B), in the known feeding apparatus 500, an auxiliary feeding roller 510 having the same shape as the feeding roller 501 is disposed on a shaft the same as a driving shaft of the feeding roller 501 and on the 80-column side opposed to the 1-column side. Accordingly, even when the sheet having the comparatively large width is fed, the 80-column side 509 of the sheet is pressed, thereby suppressing the 80-column side 509 of the sheet from lifting in the frontage opening section 507. As a result, the feeding roller 500 is configured to suppress the skew from occurring due to the lifting.

However, when the auxiliary feeding roller 510 is disposed on the 80-column side, a feeding roller shaft-(not shown) needs to extend to the 80-column side. Accordingly, there is a possibility that accuracies of components will be difficult to control. There is a possibility that the long feeding roller shaft will result in an increase in cost.

SUMMARY

Therefore, an object of the invention is to provide a feeding apparatus in which a skew is suppressed from occurring by lifting of a recording medium without an auxiliary feeding roller, a recording apparatus and a liquid ejecting apparatus which have the feeding apparatus.

In order to achieve the above object, according to an aspect of the invention, there is provided a feeding apparatus comprising:

a feeding roller, operable to pick up a stacked first medium and to feed the picked up first medium in a transporting direction;

a medium guide, disposed downstream of the feeding roller in the transporting direction to guide the fed first medium;

a pair of transporting rollers, operable to transport the guided first medium, wherein:

the feeding roller is disposed at one side deviated from the center of the medium guide in a main scanning direction which is a widthwise direction of the fed first medium;

the medium guide has a first guide section and a second guide section having a path for guiding the fed first medium different from that of the first guide section, the first guide section and the second guide section arranged in the main scanning direction;

the first guide section is disposed at the one side where the feeding roller is deviated in the main scanning direction; and the second guide section is disposed at the other side in the main scanning direction.

By this configuration, the medium guiding section includes the first guide section and the second guide section which are arranged in the main scanning direction, wherein the second guide section is disposed on the other side further deviated from the feeding roller in the main scanning direction and the second guide section is disposed at the same position as the first guide section in a sub scanning direction, and guides the first medium to the pair of transporting rollers at a position retreated to the downside with respect to the first guide section. Accordingly, in the second guide section disposed on the other side further deviated from the feeding roller at time when the first medium is fed, the first medium is not restricted by the feeding roller and is lifted and thus, even when the sheet path (track) of the first medium on the second guide section side is shorter than the medium path (track) of the first medium on the first guide side in the vicinity of the feeding roller, the medium path (track) on the other side further deviated from the feeding roller can be lengthened. Accordingly, it is possible to reduce a difference between the length of the medium path (track) of the second guide section on the other side further deviated from the feeding roller and the length of the medium path (track) of the first guide section in the vicinity of the feeding roller. It is possible to suppress the skew of the medium from occurring by the difference between the lengths of the medium paths (tracks). As the result, it is not necessary to dispose an auxiliary feeding roller. In addition, since it is not necessary to extend the shaft of the feeding roller to the 80-column side, it is possible to reduce a cost so much. Accuracies of components become comparatively easy to manage.

The first guide section may be adapted to guide the first medium to the transporting rollers while supporting the first medium from below between the feeding roller and the transporting rollers; and the second guide section may be adapted to guide the first medium to the transporting rollers at a position downwardly retreated with respect to the first guide section.

By this configuration, the second guide section of the first medium is circumvented to the downside from the first guide section by the second guide section's own weight, whereby a medium path (track) of the second guide section can be lengthened.

The second guide section may be downwardly retreated with respect to the first guide section so that a length of a first path ranging from the first guide section to the transporting rollers is the same as a length of a second path ranging from the second guide section to the transporting rollers.

By this configuration, the second guide section downwardly retreats from the first guide section so that a length of the first path of the first medium which is restricted by the feeding roller and is not lifted in the first guide section, which is disposed in the range of from the feeding roller to the pair of transporting rollers in the sub scanning direction, is the same as a length of the second path of the first medium which is not restricted by the feeding roller and is lifted in the second guide section, which is disposed in the range of from the feeding roller to the pair of transporting rollers. Accordingly, even when the lifting occurs, it is possible to further suppress the skew from occurring by the lifting. Here, "paths" in "the first path" and "the second path" represent tracks at the time when the first medium is transported.

The second guide section may have a flat section downwardly retreated with respect to the first guide section; and the flat section may be adapted to support a second medium which is subjected to recording only in the range of the second guide section from the below to guide the second medium.

By this configuration, the second guide section includes the flat section. That is to say, the second guide section serves to guide the second medium by using the shape of the second guide section. Accordingly, it is not necessary to dispose a new guide section guiding the second medium separately. The second medium is available in the recording apparatus in addition to the first medium.

In a specification of the invention, "the first medium" represents a recording medium, for example, "an unrigid medium" and "the second medium" represents the recording medium, for example, "a rigid medium". Here, "the unrigid medium" represents a medium having flexibility, such as the sheet, an OHP sheet, or the like. In addition, "the rigid medium" represents a medium scarcely having the flexibility, such as a dedicated CD-R tray having the CD-R attached thereto. "The rigid medium" also includes a rigid and thick sheet such as a cardboard.

The first guide section may have a first guide surface;

the second guide section may have a second guide surface; and at least a part of the second guide surface may be lower than the first guide surface in a vertical direction.

According to another aspect of the invention, there is also provided a recording apparatus, comprising:

a feeding section, operable to feed a first medium; and a recording section, operable to perform recording by ejecting ink to the fed first medium and a second medium, wherein the feeding section has the above feeding apparatus.

By this configuration, the recording apparatus has the feeding apparatus, whereby it is possible to acquire the same advantageous effects as the above described advantageous effects of the feeding apparatus.

According to a further aspect of the invention, there is also provided a liquid ejecting apparatus, comprising:

a feeding section, operable to feed a first medium; and a liquid ejecting section, operable to eject liquid to the fed first medium, wherein the feeding section has the above feeding apparatus,

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Hereinafter, according to an embodiment of the invention, a feeding apparatus and a recording apparatus as an example of a liquid ejecting apparatus employing the feeding apparatus will be described. First, an overall configuration of an ink jet printer as a best mode for carrying out the liquid ejecting apparatus and the recording apparatus as an example of the liquid ejecting apparatus is schematically described with reference to the drawings.

Figure 1:
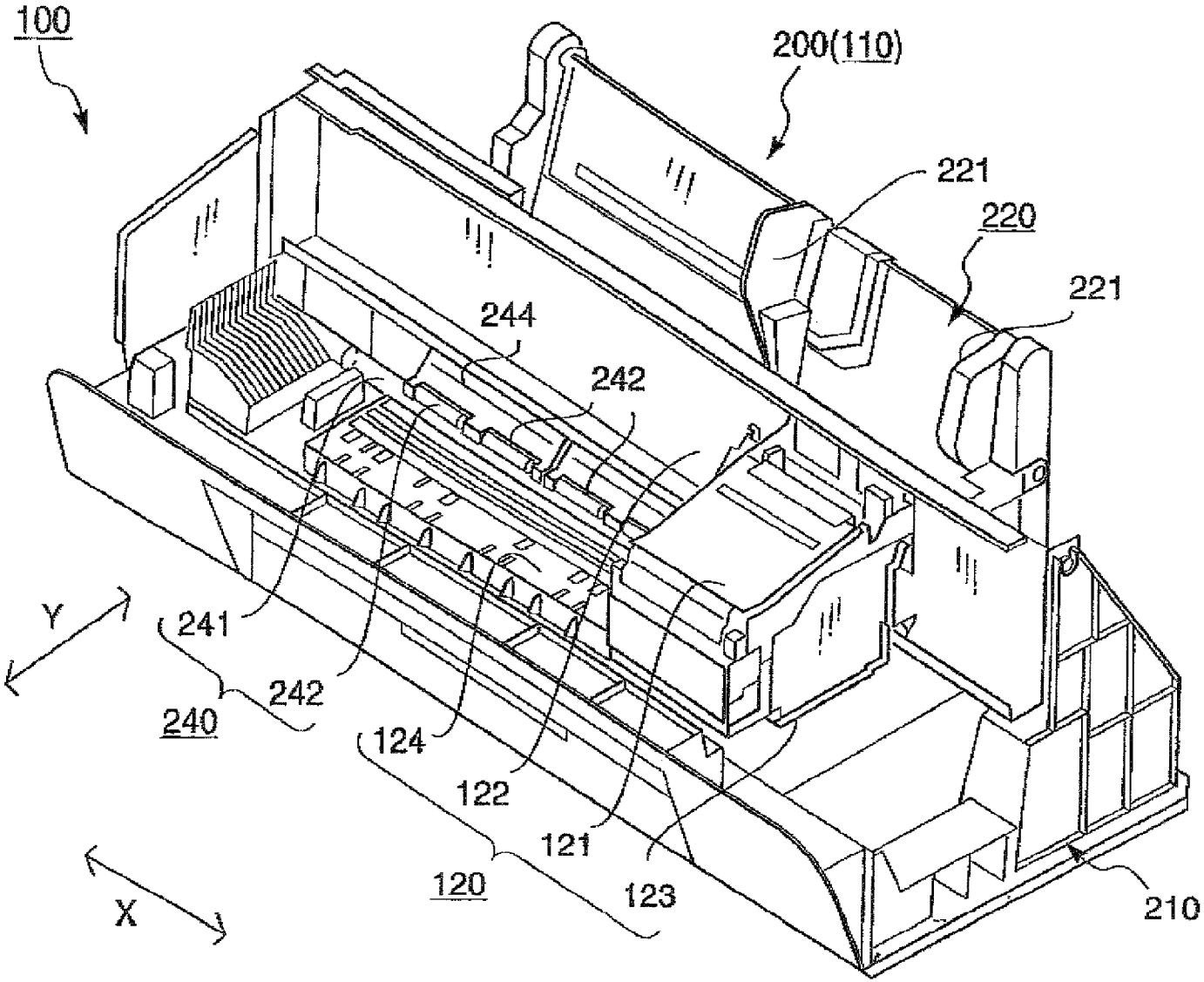
FIG. 1 is an overall perspective view illustrating the inside of a recording apparatus according to an embodiment of the invention.
Figure 2:
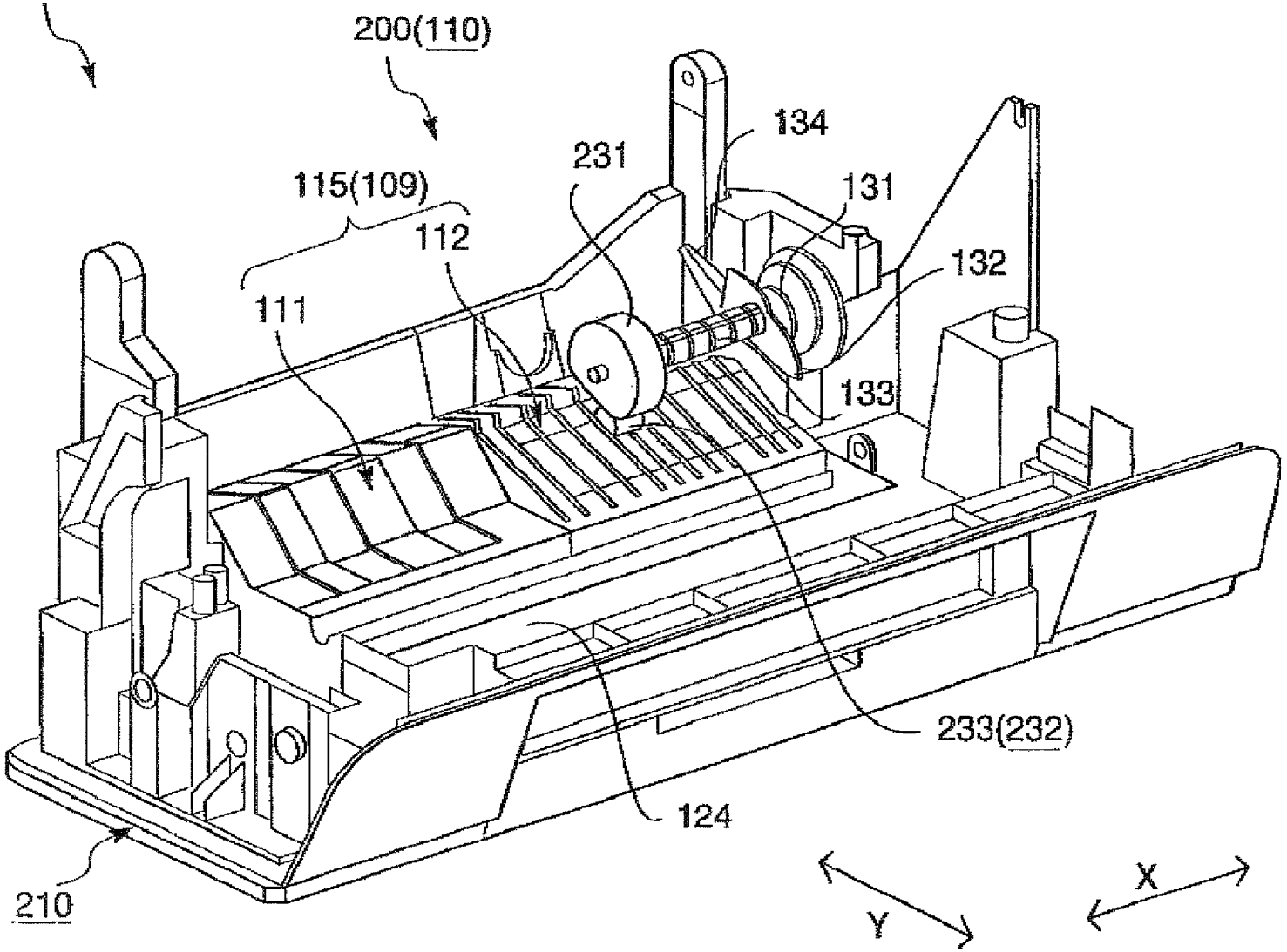
FIG. 2 is an overall perspective view illustrating parts excluding a recording section from the inside of the ink jet printer shown in FIG. 1.
Figure 3:
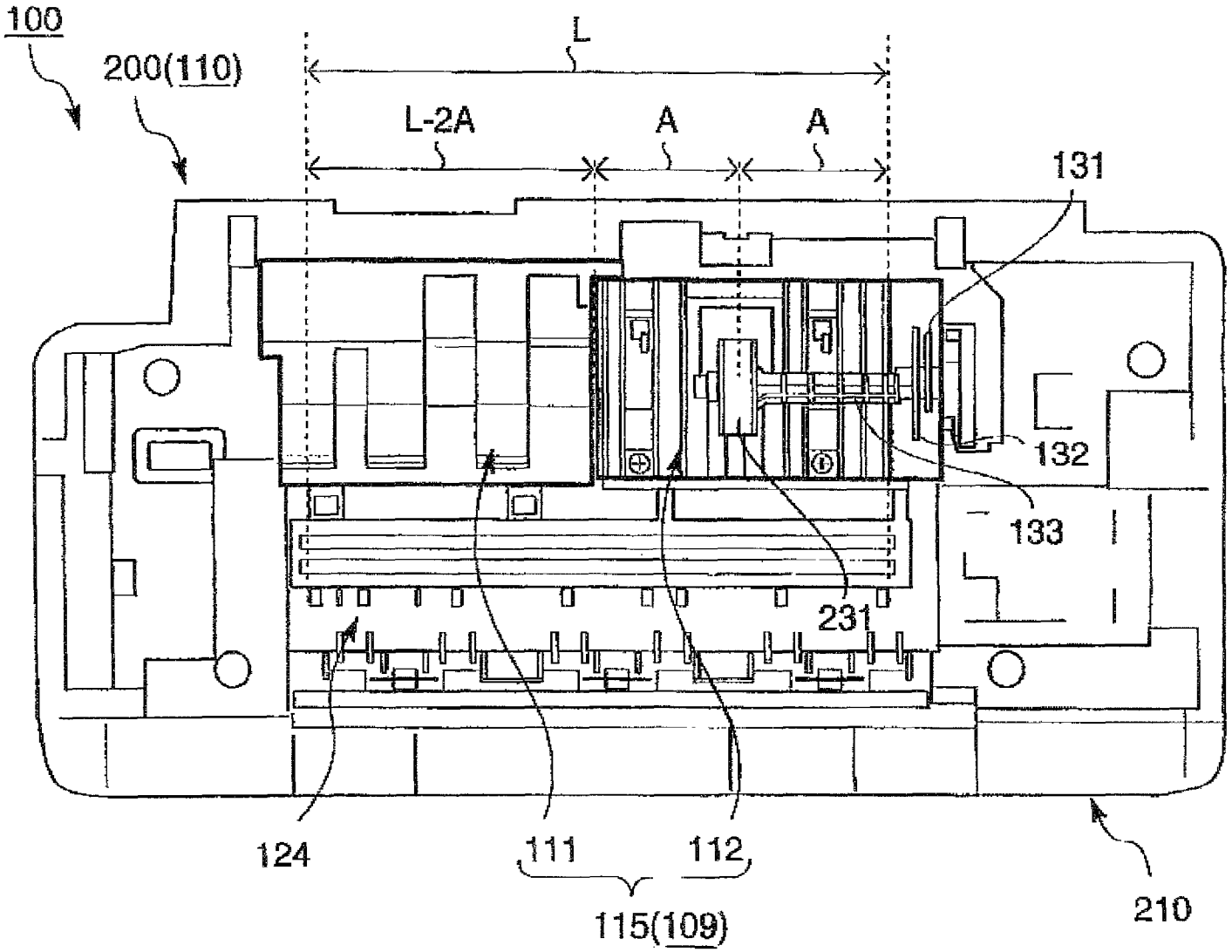
FIG. 3 is an overall plan view of FIG. 2.

FIG. 1 is an overall perspective view illustrating the inside of the ink jet printer according to the embodiment of the invention. FIG. 2 is an overall perspective view illustrating parts excluding a recording section from the inside of the ink jet printer shown in FIG. 1. FIG. 3 is an overall plan view of FIG. 2.

As shown in FIGS. 1 to 3, an ink jet printer 100 includes a feeding section 110 feeding a recording medium P (hereinafter, simply referred to as a sheet P) as an example of a liquid ejection medium and a recording section 120 performing recording on the sheet P fed from the feeding section 110. A feeding apparatus 200 serving as the feeding section 110 includes a hopper 220 serving as a stack section for stacking the sheet P, a feeding roller 231 having a D shape as viewed from a side surface where the sheet P is picked up from the hopper 220, and a pair of transporting rollers 240 transporting to the recording section 120 the sheet P transported from the feeding roller 231.

A lower part of the hopper 220 is configured to pivot so as to he contacted with and separated from the feeding roller 231 about an upper part of a back surface of the ink jet printer 100. Specifically, the lower part of the hopper 220 is constantly urged toward the feeding roller by an urging force (not shown). Meanwhile, a spindle section 133 in which the feeding roller 231 is disposed is rotated by a power unit (not shown). A second cam unit 132 disposed in the spindle section 133 is rotated with rotation of the spindle section 133. The second cam unit 132 pivots the hopper 220 in contact with the lower part of the hopper 220.

Here, the sheet P is restricted by a pair of side edge restriction units 221 and 221 disposed in a main scanning direction X in the hopper 220. Reference numeral Y represents a sub scanning direction in which the sheet P is transported.

When the feeding roller 231 having the D shape as viewed from a side surface rotates once in a counterclockwise direction at the timing when the hopper 220 pivots in FIG. 2, the position of the feeding roller 231 opposed to the hopper 220 is shifted from a string portion to a arc portion, and the lower part of the hopper 220 comes close to the feeding roller. Accordingly, the top-most sheet P stacked in the hopper 220 is picked up by the feeding roller 231 and is fed to the pair of transporting rollers disposed downstream. When the feeding roller 231 rotates by a predetermined distance, the hopper 220 is moved in a direction deviated from the feeding roller 231 by the second cam unit 132.

A retard roller 233 requiring a constant load for rotation, as an example of separation means 232, is disposed at a position of a base section 210 opposed to the feeding roller 231. When a friction coefficient between the feeding roller 231 and the sheet P is denoted by $\mu 1$, a friction coefficient between the retard roller 233 and the sheet P is denoted by $\mu 2$, and a friction coefficient between the sheet P and the sheet P is denoted by $\mu 3$, the relations between the friction coefficients is satisfied by $\mu 1 > \mu 3$ and $\mu 2 > \mu 3$. Accordingly, even when a phenomenon in which a plurality of sheets is bitten into a frontage opening section 245 (see FIG. 4) disposed in the vicinity of the feeding roller 231 and the retard roller 233, that is, an avalanche phenomenon occurs, only one sheet of sheet P being in contact with the feeding roller 231 is fed to the pair of transporting rollers 240 by rotation of a sheet feeding roller and other sheets are restricted from moving to the pair of transporting rollers by the retard roller 233.

Subsequently, when the hopper 220 returns to an original position deviated from the feeding roller 231, a first cam unit 131 disposed in the spindle section 133 is in contact with a cam follower 134. A sheet retracting lever (not shown) is disposed integrally with the cam follower 134 and the sheet retracting lever is rotated with rotation of the cam follower 134. The sheet retracting lever enables a sheet additionally fed when the sheet P is fed by the feeding roller 231 to be rolled back to the hopper 220. Accordingly, the sheet restricted by the retard roller 233 is retracted to the hopper 220 by the sheet retracting lever.

So-called removal of the skew is performed with respect to the sheet P transported to the pair of transporting rollers 240.

Here, "the removal of the skew" may be carried out by any method of a so-called "bite and discharge method" in which the sheet P is bent by reversely rotating the pair of transporting rollers 240 and discharging a leading edge of the sheet P after the leading edge of the sheet P is bitten into the pair of transporting rollers 240 and a so-called "knocking method" in which the sheet P is bent by knocking the leading edge of the sheet P against the pair of transporting rollers 240.

The pair of transporting rollers 240 includes a transport driving roller 241 driven by a power transmitted from the power unit and a transport driven roller 242 rotating in accordance with rotation of the transport driving roller 241. The transport driven roller 242 is rotatably held by a holder section 244 and is urged toward the transport driving roller.

The sheet P is transported to the recording section 120 by rotation of the transport driving roller 241 and recording is performed on the sheet P by the recording section 120.

The recording section 120 includes a recording head 123 discharging ink to the sheet P, a platen 124 which supports the sheet P from below, i.e., from the downside in a vertical direction, and which guides the sheet P to a position opposed to the recording head 123, a carriage 121 which has the recording head 123 and moves in the main scanning direction X, and a carriage guiding section 122 which is mounted on the base section 210 and which guides the carriage 121 in the main scanning direction X.

The sheet P is transported by rotation of the transport driving roller 241 and the recording head 123 discharges the ink by scanning the carriage 121 in the main scanning direction X, whereby the recording is performed.

A sheet guiding section 115 which supports the sheet P from the downside in the vertical direction and which guides the sheet P to the pair of transporting rollers 240 is disposed on a transport path 109 of the sheet P in the feeding apparatus 200. In the main scanning direction X of the sheet guiding section 115, a first guide section 112 is disposed on a 1-column side where the feeding roller 231 is disposed and a second guide section 111 retreating to the downside from the first guide section 112 is disposed on an 80-column side.

As shown in FIGS. 2 and 3, the feeding roller 231 is deviated to the 1-column side (a right side shown in FIG. 3) about the center of an overall width of the transport path 109 in the main scanning direction X. Accordingly, since a pressing force of the feeding roller 231 is not imposed, when a so-called lifting phenomenon occurs on the 80-column side (a left side shown in FIG. 3) of the sheet P, there is a possibility that an actual sheet path (track) of the 80-column of the sheet will be shorter than the actual sheet path (track) of the 1-column side of the sheet on the transport path 109 as described above. The second guide section 111 retreats to the downside from the first guide section 112 by the shortened length of the actual sheet path thereof, whereby the sheet path (track) of the 80-column side is lengthened. Accordingly, as described below, a difference between the sheet path (track) of the 80-column side and the sheet path (track) of the 1-column side is reduced, whereby it is possible to suppress the skew from occurring due to the difference.

In other words, the first guide section 112 has a first guide surface for guiding the sheet P and the second guide section 111 has a second guide surface. At least a part of the second guide surface is lower than the first guide surface in the vertical direction.

The feeding roller 231 is positioned substantially in the center of a part actually guiding the sheet in the first guide section 112 in the main scanning direction X. When a width of the part actually guiding the sheet in the first guide section 112 is set to '2 A' in the main scanning direction X, a distance from the center of the feeding roller 231 to an edge of the part actually guiding the sheet in the first guide section 112 is set to 'A'. When an overall width of the part actually guiding the sheet in the sheet guiding section 115, that is, the maximum width of a sheet to be recordable is set to 'L', the width of the part actually guiding the sheet in the second guide section is given by L-2A.

In the embodiment, the length 2A is approximately ⅓ to ⅔ shorter than the length L.

The second guide section 111 is positioned in a range where the sheet fed by the feeding roller 231 is not restricted by the feeding roller 231 and is lifted in a vertical direction substantially perpendicular to the main scanning direction X. The range is changed depending on the size of the sheet, the kind of the sheet, and the like. In the embodiment, the second guide section 111 is disposed so as to cover all sizes and all kinds of sheets on which the recording apparatus 100 can perform recording.

The 80-column side of the spindle section 133 of the feeding roller 231 is supported by a bearing section (not shown) disposed on a back surface of the carriage guiding section 122.

Figure 4A:
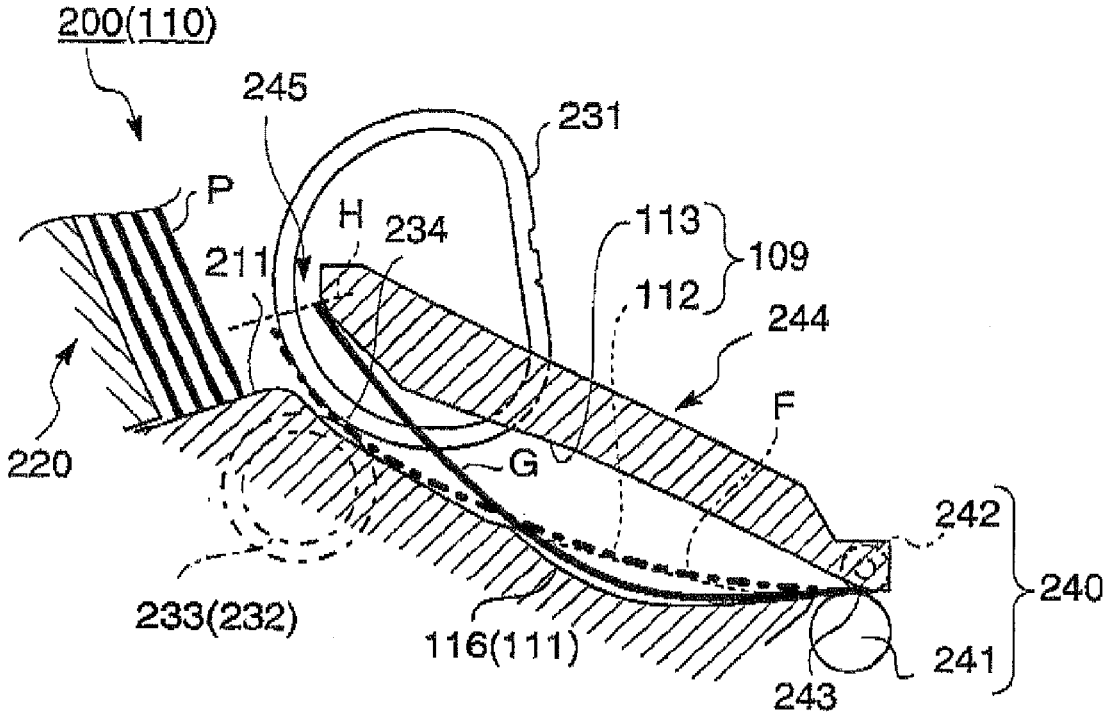
FIGS. 4(A) and 4(B) are side sectional views illustrating a transport path of a feeding apparatus according to an embodiment of the invention.
Figure 4B:
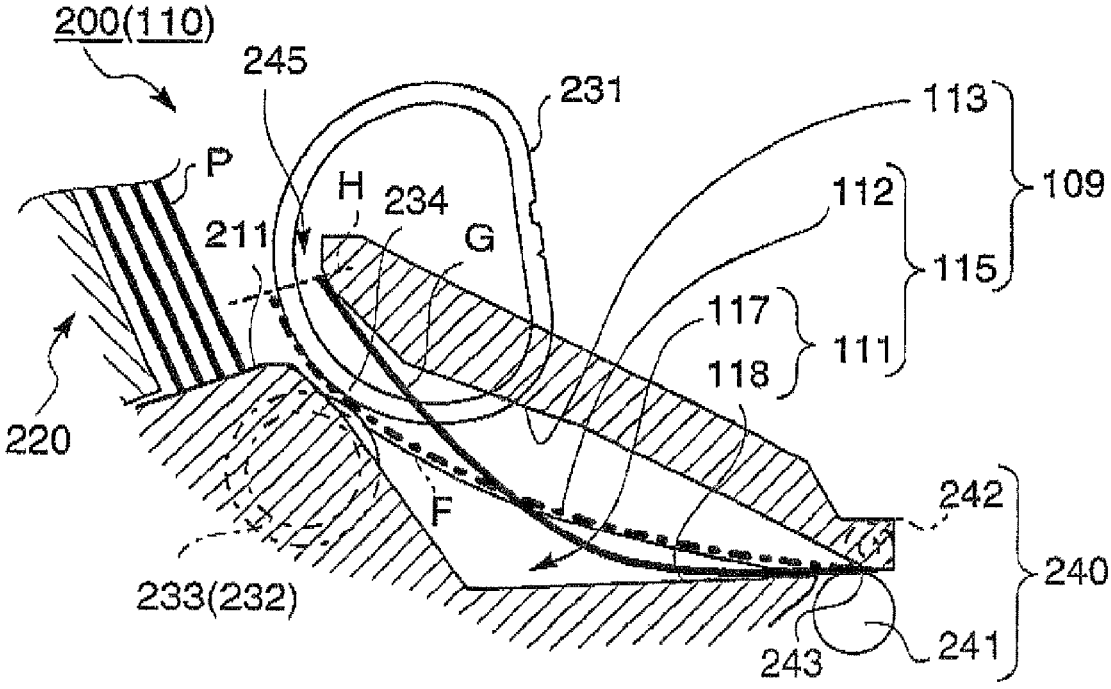

FIGS. 4(A) and 4(B) are side sectional views illustrating a transport path of the feeding apparatus according to the embodiment of the invention. Of them, FIG. 4(A) is a side sectional view illustrating the concept of the invention. Meanwhile, FIG. 4(B) is a side sectional view of the embodiment of the invention.

As shown in FIGS. 4(A) and 4(B), the feeding apparatus 200 includes the transport path 109 for guiding the sheet P picked up by the feeding roller 231 to the pair of transporting rollers 240. The transport path 109 disposed in the vicinity of the feeding roller on the 1-column side in the main scanning direction is constituted by the first guide section 112 disposed in the base section 210 of the feeding apparatus 200 and an upper guide section 113 disposed in the holder section.

The hopper 220 in which the sheets P are stacked is disposed upstream of the feeding roller 231 and the leading edge of the sheet P is supported by a bank section 211 from the downside. When the feeding roller 231 picks up the sheet P by pivoting of the hopper 220 and rotation of the feeding roller 231, the sheet P is transported to a contact point 234 of the feeding roller 231 and the retard roller 233 through the frontage opening section 245 which is an entrance of the transport path 109 and which is constituted by the first guide section 112 and the feeding roller 231. As described above, the sheet additionally entering the frontage opening section 245 is separated by the retard roller 233 and the sheet additionally entering the frontage opening section 245 is retracted to the hopper 220 by the sheet retracting lever (not shown).

When the sheet P is fed, the leading edge of the sheet P is guided to the first guide section 112 and the upper guide section 113 and the leading edge of the sheet P reaches the nip point 243 of the pair of transporting rollers 240. When the leading edge of the sheet P reaches the nip point 243, the leading edge of the sheet P is pinched between the pair of transporting rollers 240 by driving of the transport driving roller 241 in the clockwise direction.

At this time, the removal of the skew is carried out by the so-called "bit and discharge method". Specifically, the feeding roller 231 and the transport driving roller 241 stops to drive with the sheet P pinched between the pair of transporting rollers 240, that is, with the sheet P bitten into the pair of transporting rollers 240. The transport driving roller 241 is reversely driven in the counter clockwise direction with the feeding roller 231 stopped. Accordingly, the pair of transporting rollers 240 can discharge the leading edge of the sheet P upstream. At this time, the sheet P is bent between the contact point 234 and the nip point 243 and the leading edge of the sheet P imitates the main scanning direction X of the nip point 243, that is, a nip line. Accordingly, it is possible to remove the skew. Then, the sheet P in which the skew is removed is transported to the recording section 120 disposed downstream by normally rotating the feeding roller 231 in the counter clockwise direction and by normally rotating the transport feeding roller 241 in the counter clockwise direction.

The "bite and discharge method" is carried out to remove the skew, but the sheet P can be also bent when the so-called "knocking method" in which the leading edge of the sheet P is knocked against the pair of transporting rollers 240 being stopped is carried out similarly as when the "bite and discharge method" is carried out.

As described above, the 1-column side of the sheet on the first guide section is pressed by the feeding roller 231. Meanwhile, the pressing force of the feeding roller 231 is not imposed to the 80-column side of the sheet on the second guide section, whereby the "lifting phenomenon" occurs. The sheet path (track) of the 80-column side of the sheet in which the lifting occurs takes a shortcut by being lifted, whereby the sheet path (track) of the 80-column side of the sheet becomes shorter than the sheet path (track) of the 1-column side of the sheet. Accordingly, the sheet path on the 80-column side is shortened by taking the shortcut and thus, the 80-column side of the sheet is precedently fed to the pair of rollers 240, whereby there is a possibility that the skew will occur.

Therefore, as shown in FIG. 4(A), the second guide section 111 has a retreat section 116 retreating from the first guide section 112 to the downside in the vertical direction. Regarding the degree of retreat, the 80-column side of the sheet is shortened by taking the shortcut and thus, the retreat section 116 retreats between the feeding roller 231 and the pair of transporting rollers 240 so as to circumvent the 80-column side of the sheet by the sheet P's own weight. At this time, a shape and a position of the retreat section 116 is determined by considering that the sheet P is differently bent by each kind and each size of the sheet. Accordingly, in the range of from the frontage opening section 245 to the pair of transporting rollers 240, the length of a sheet path (track) F of the 1-column side of the sheet on the first guide section can be the same as the length of a sheet path (track) G of the 80-column side of the sheet on the second guide section.

Reference numeral H represents an origin point upstream of the sheet path (track) F of the 1-column side of the sheet and the sheet path (track) G of the 80-column side of the sheet.

As shown in FIG. 4(B), in the embodiment, the second guide section 111 includes a retreat guiding section 117 retreating to the downside from the first guide section 112. A flat section 118 which extends toward the nip point 243 of the pair of transporting rollers 240 and which guides the sheet P to the nip point 243 is disposed in the retreat guiding section 117. That is to say, the pair of transporting rollers which is locations being in contact with the leading edge of the 80-column side of the sheet in the second guide section 111 at the time of feeding the sheet has the same shape as the first guide section 112 and the flat section 118 extends upstream so that the entire upstream side of the location is removed, that is, the entire upstream side retreats to the downside. The flat section 118 is disposed in a small location in the vicinity of the pair of transporting rollers 240 so as to guide the leading edge of the sheet P to the nip point 243 of the pair of transporting rollers 240. Accordingly, the leading edge of the 80-column side of the sheet is in a so-called free state until the leading edge of the 80-column side of the sheet is transported adjacent to the pair of transporting rollers 240. When the 1-column side of the sheet pinched between the feeding roller 231 and the retard roller 233 is fed, the leading edge of the 80-column side of the sheet is naturally guided by the 1-column side of the sheet, whereby the leading edge of the 80-column side of the sheet can enter the pair of transporting rollers 240 with the 1-column side of the sheet substantially at the same time. Accordingly, the skew occurring due to the lifting does not occur theoretically.

As described above, a bending degree at the time when the lifting phenomenon occurs depends on the kind and the size of the sheet and humidity. The flat section 118 is disposed downstream of the retreat guiding section 117, whereby it is possible to cope with various bendings. That is to say, in the range of from the frontage opening section 245 to the pair of transporting rollers 240, the length of the sheet path (track) F of the 1-column side of the sheet on the first guide section can be the same as the length of the sheet path (track) G of the sheet of the 80-column side of the sheet on the second guide section by coping with the various bendings.

Figure 5:
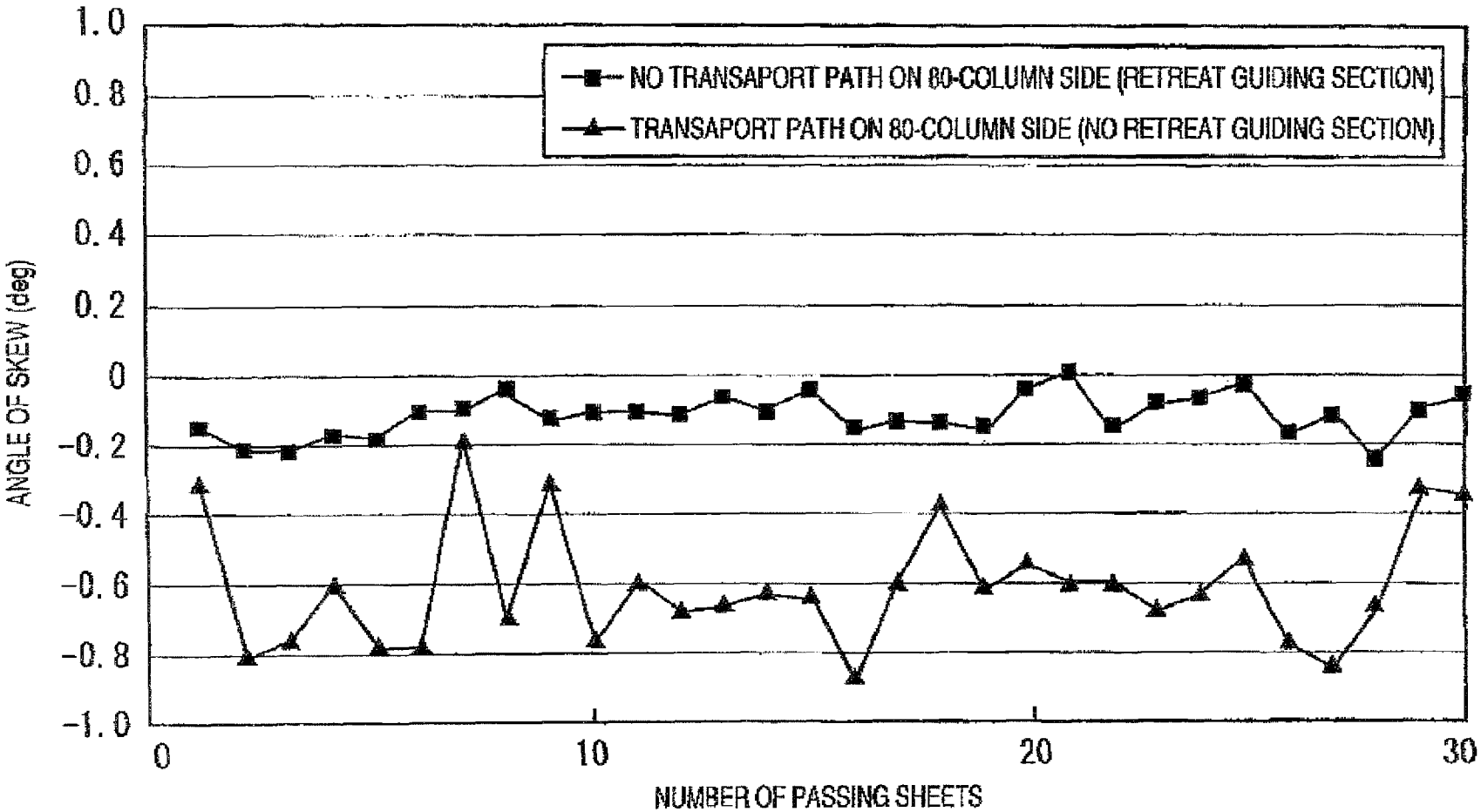
FIG. 5 is a graph illustrating the comparison of the degree of the skew in a feeding apparatus according to an embodiment of the invention and the degree of the skew in a feeding apparatus in related art.

FIG. 5 is a graph illustrating the comparison between the degree of the skew in the feeding apparatus according to the embodiment of the invention and the degree of the skew in the feeding apparatus in related art. A vertical axis of the graph represents a skew angle of the sheet and a horizontal axis of the graph represents the number at which the sheet is fed.

Here, positive values of the skew angle represent an inclination in a direction in which the 1-column side precedes the 80-column side and negative values of the skew angle represent an inclination in a direction in which the 80-column side precedes the 1-column side.

The graph shown in FIG. 5 represents a result when 30 sheets of sheet having the same size are used, the sheets are fed at the speed of 14 ips (inch/second), and the removal of the skew is not performed.

Symbol ▲ indicates that the sheet is supported from the downside in the overall range which has the 80-column side of the sheet between the feeding roller and the pair of transporting rollers. That is to say, symbol ▲ is the data of the feeding apparatus in related art in which the retreat guiding section 117 is not disposed.

Meanwhile, Symbol ■ indicates that the sheet is supported from the downside only in some locations without the 80-column side of the sheet in the vicinity of the pair of transporting rollers between the feeding roller and the pair of transporting rollers. That is to say, symbol ■ is the data of the feeding apparatus according to the embodiment of the invention, which has the retreat guiding section 117.

As shown in FIG. 5, in the feeding apparatus of symbol ▲, the lifting phenomenon occurs on the 80-column side of the sheet as described above and the sheet path (track) of the 80-column of the sheet is shortened. Accordingly, in an overall level, the 80-column side of the sheet tends to precede the 1-column side of the sheet.

Figure 8A:
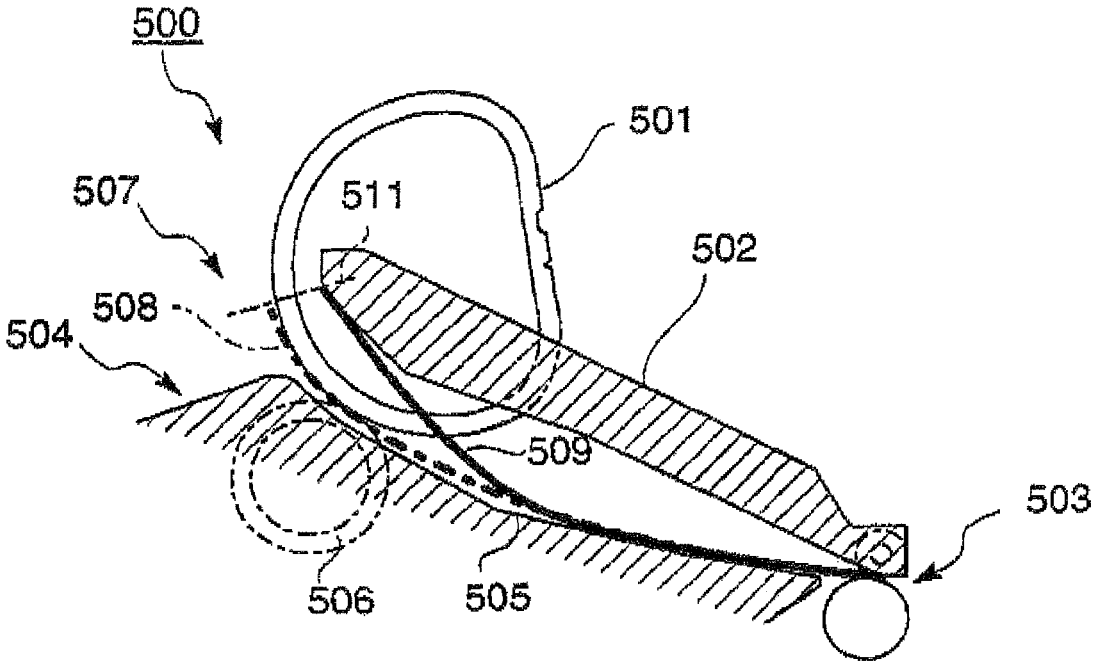
FIGS. 8(A) and 8(B) are side sectional views illustrating a transport path of a feeding apparatus in related art.
Figure 8B:
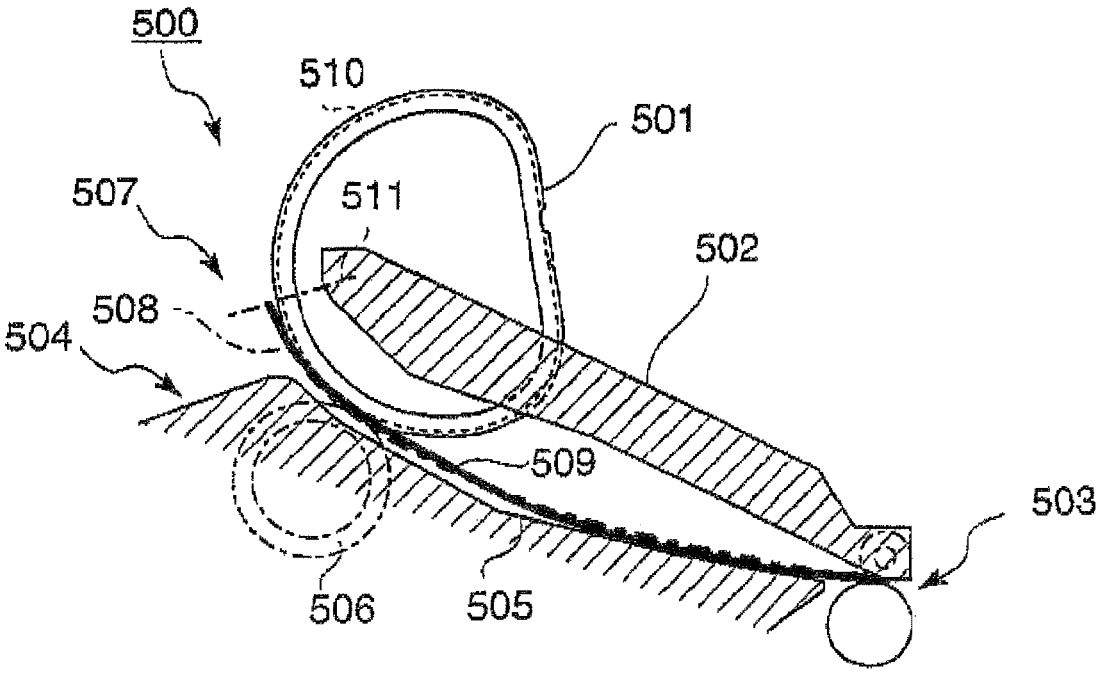

Unevenness in a friction resistance between sheet (reference numeral 509 shown in FIG. 8) and the transport path (reference numerals 502 and 505 shown in FIG. 8) on the 80-column side occurs due to unevenness of the degree of the lifting phenomenon, whereby unevenness in the degree of the skew also occurs.

Meanwhile, the feeding apparatus 200 of symbol ■ according to the embodiment of the invention, the length of the sheet path (track) G of the 80-column side of the sheet can be the same as the length of the sheet path (track) F of the 1-column side of the sheet as described above. Accordingly, the overall level is substantially identical to 0 and the skew scarcely occurs.

A friction resistance between the sheet P and the transport path 109 scarcely occurs on the 80-column side of the sheet by the retreat guiding section 117. Accordingly, even when the skew occurs a little, unevenness in the degree of the skew can be remarkedly reduced.

The feeding apparatus 200 of the embodiment includes the feeding roller 231 picking up the sheet P as the stacked first medium and feeding the picked-up sheet P downstream, the sheet guiding section 115 as the medium guiding section guiding the fed sheet P to the pair of transporting rollers 240, and the pair of transporting rollers 240 transporting the guided sheet P to the recording section 120, wherein the feeding roller 231 is placed at a position deviated from the center of the medium guiding section 115(L) in the main scanning direction X which is a width wise direction of the fed sheet P, and the medium guiding section 115 has the first guide section 112 and the second guide section 111 which are arranged in the main scanning direction X, wherein the first guide section 112 is disposed on a side where the feeding roller 231 is deviated in the main scanning direction X and supports the sheet P from the downside in the vertical direction and guides the pair of transporting rollers 240 between the feeding roller 231 and the pair of transporting rollers 240, and the second guide section 111 is disposed on one side further deviated from the feeding roller 231 in the main scanning direction X and is disposed at the same position as the first guide section 112 in a sub scanning direction Y, and guides the sheet P to the pair of transporting rollers 240 at a position retreating to the downside from the first guide section 112.

The second guide section 111 of the embodiment retreats to the downside from the first guide section 112 so that the sheet path (track) F of the 1-column side of the sheet as a first path ranging from the feeding roller 231 to the pair of transporting rollers 240 in the sub scanning direction Y of the sheet P which is restricted by the feeding roller 231 and is not lifted in the first guide section 112 can be the same length as the sheet path (track) G of the 80-column side of the sheet as a second path ranging from the feeding roller 231 to the pair of transporting rollers 240 in the sub scanning direction of the sheet P which is not restricted by the feeding roller 231 and is lifted in the second guide section 111.

In the embodiment, the second guide section 111 is in the main scanning direction positioned in a range where the sheet fed by the feeding roller 231 is not restricted by the feeding roller 231 and is lifted in the main scanning direction X.

The feeding roller 231 according to the embodiment is disposed in the center of the first guide section 112(2A) in the main scanning direction X.

The recording apparatus 100 according to the embodiment includes the feeding section 110 picking up the stacked sheet P and feeding the sheet P to the recording section and a recording apparatus 120 performing recording by discharging ink to the sheet P, wherein the feeding section 110 has the feeding apparatus 200.

Another Embodiment

Figure 6:
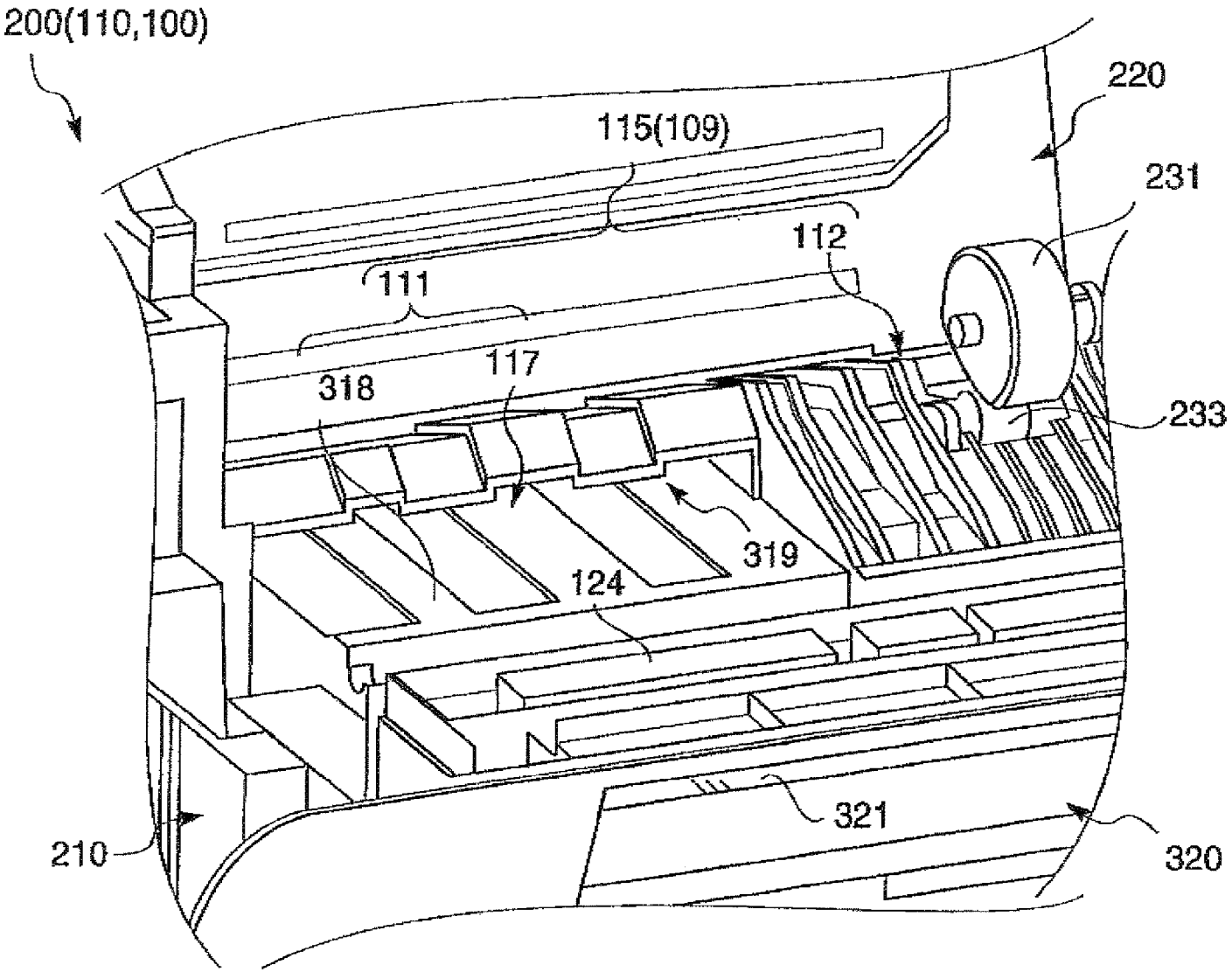
FIG. 6 is a perspective view illustrating a feeding apparatus according to another embodiment.
Figure 7:
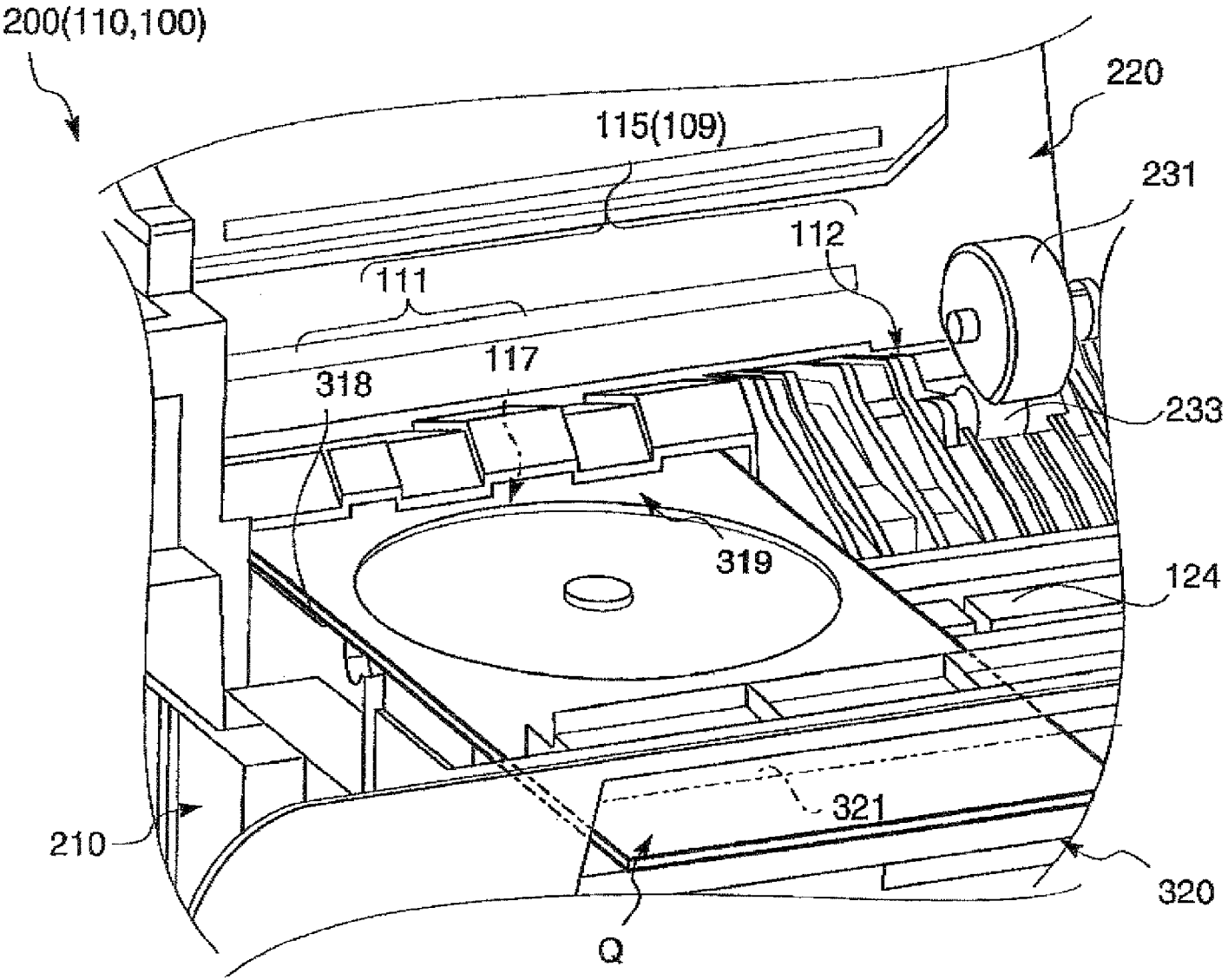
FIG. 7 is a perspective view illustrating a feeding apparatus according to another embodiment (with a CD-R tray)

FIGS. 6 and 7 are perspective views illustrating a feeding apparatus according to another embodiment. Of them, FIG. 6 is a diagram without a CD-R tray and FIG. 7 is a diagram with the CD-R.

As shown in FIG. 6, a flat section 318 of the second guide section 111 is as high as and parallel with an upper surface of a platen 124 and extends further upstream in comparison with the above-mentioned embodiment. A tray opening section 319 into which a CD-R tray Q can be inserted, which has the flat section 318 on the bottom surface thereof, is disposed in the retreat guiding section 117 of the second guide section 111.

A discharge section 320 for discharging the sheet P is disposed on a front surface (a front side in FIGS. 6 and 7) of the recording apparatus 100. A discharge opening section 321 for discharging the sheet P from the inside to the outside of the recording apparatus 100 is disposed in the discharge section 320. The other elements are equal to those of the above-mentioned embodiments and are thus denoted by like reference numerals, and description thereof is omitted.

As shown in FIG. 7, in the recording apparatus 100, the CD-R tray Q in which a CD-R can be locked onto a top surface thereof can be inserted and set through the discharge opening section 321. The set CD-R tray Q is once transported upstream by reversely rotating the transport driving roller 241 or a discharge driving roller (not shown). At this time, the CD-R tray Q is guided to the flat section 318 and is moved to the inside of the tray opening section 319. The transport driving roller 241 or the discharge driving roller (not shown) is normally rotated and the carriage 121 of the recording section 120 is scanned in the main scanning direction X and thus, ink is discharged to a recording surface (label) of the CD-R from the recording head 123, whereby recording is performed. When the recording is finished, a user grips a part of the CD-R tray Q protruding toward the front side from the discharge opening section 321 to take out the CD-R tray Q from the recording apparatus 100.

Since the CD-R and the CD-R tray Q are rigid bodies at the time of performing the recording on the recording surface (label) of the CD-R, the CD-R tray Q needs to be moved in the sub scanning direction Y lest the CD-R tray Q should be bent. That is to say, a transport path of the CD-R tray Q needs to extend in a straight line. Accordingly, the transport path of the CD-R tray Q needs to be different from the transport path of the sheet P stacked in the hopper 220. In this case, the feeding apparatus 200 of the recording apparatus 100 according to another embodiment of the invention needs to have the transport path of the CD-R tray Q by using the retreat guiding section 117 of the second guide section 111. That is to say, the second guide section 111 can guide the sheet P and the CD-R tray Q. Accordingly, it is possible to achieve compactification of the recording apparatus 100.

The second guide section 111 of another embodiment includes the flat section 318, wherein the flat section 318 retreat to the downside with respect to the first guide section 112 and guides the sheet P to the pair of transporting rollers 240 and guides the CD-R tray Q as the second medium, which is subjected to recording only in the range of the second guide section 111 in the main scanning direction X, wherein the CD-R tray Q is supported from the downside by the flat section 318 and is guided in the main scanning direction of the sheet guiding section 115 as the medium guiding section.

The recording apparatus 100 according to another embodiment includes the feeding section 110 picking up the stacked sheet P and feeding the sheet P to the recording section and the recording apparatus 120 performing the recording by discharging the ink to the sheet P and the CD-R (Q), wherein the feeding section 110 has the feeding apparatus 200.

The invention is not limited to the above-mentioned embodiments, but may be modified in various forms without departing from the scope of the invention described hi the claims. The modifications also belong to the scope of the invention.

What is claimed is:

1. A feeding apparatus comprising:

a feeding roller, configured to pick up a stacked sheet and to feed the picked up sheet in a transporting direction;

a medium guide, disposed downstream of the feeding roller in the transporting direction to guide the fed sheet;

a pair of transporting rollers, operable to transport the guided sheet, wherein:

the feeding roller is disposed at one side deviated from the center of the medium guide in a main scanning direction which is a widthwise direction of the fed sheet;

the medium guide has a first guide section having a first path which guides the sheet and a second guide section having a second path which guides the sheet and a rigid tray, the second path different from the first path, the first guide section and the second guide section arranged in the main scanning direction;

the first guide section is disposed at the one side where the feeding roller is deviated in the main scanning direction;

the second guide section is disposed at the other side in the main scanning direction; and the second guide section has a flat section formed as a surface which is as high as and parallel with an upper surface of a platen, the flat section configured to guide the sheet and the rigid tray and an opening section into which the rigid tray is insertable, the opening section continuously provided with the flat section.

2. The feeding apparatus as set forth in claim 1, wherein:

the first guide section guides the sheet to the transporting rollers while supporting the sheet from below between the feeding roller and the transporting rollers; and the second guide guides the sheet to the transporting rollers at a position downwardly retreated with respect to the first guide section.

3. The feeding apparatus as set forth in claim 1, wherein the second guide section is downwardly retreated with respect to the first guide section so that a length of the first path ranging from the first guide section to the transporting rollers is the same as a length of the second path ranging from the second guide section to the transporting rollers.

4. The feeding apparatus as set forth in claim 1, wherein:

the first guide section has a first guide surface;

the second guide section has a second guide surface; and at least a part of the second guide surface is lower than the first guide surface in a vertical direction.

5. A recording apparatus, comprising:

a feeding section, operable to feed a first medium; and a recording section, operable to perform recording by ejecting ink to the fed first medium and a second medium, wherein the feeding section has the feeding apparatus as set forth in claim 1.

6. A liquid ejecting apparatus, comprising:

a feeding section, operable to feed a first medium; and a liquid ejecting section, operable to eject liquid to the fed first medium, wherein the feeding section has the feeding apparatus as set forth in claim 1.

* * * * *